US006296053B1

(12) United States Patent
Hansen

(10) Patent No.: US 6,296,053 B1
(45) Date of Patent: Oct. 2, 2001

(54) CONTROLLED BREAKING OF CABLES IN A WELL CASING

(75) Inventor: Henning Hansen, Randaberg (NO)

(73) Assignee: Subsurface Technology AS, Stavanger (NO)

( * ) Notice: Subject to any disclaimer, the term of this patent is extended or adjusted under 35 U.S.C. 154(b) by 0 days.

(21) Appl. No.: 09/721,934

(22) Filed: Nov. 27, 2000

Related U.S. Application Data

(63) Continuation of application No. PCT/NO00/00133, filed on Apr. 18, 2000.

(30) Foreign Application Priority Data

Apr. 26, 1999 (NO) ..... 19991967

(51) Int. Cl.[7] ..... E21B 29/04

(52) U.S. Cl. ..... 166/54.6; 408/19; 408/169; 408/172

(58) Field of Search ..... 166/54.5, 54.6; 408/4, 19, 168, 169, 172

(56) References Cited

U.S. PATENT DOCUMENTS

| | | | | |
|---|---|---|---|---|
| 4,427,059 | | 1/1984 | Oliver | 166/54.5 |
| 4,660,635 | | 4/1987 | Wittrisch | 166/54.5 |
| 4,738,312 | | 4/1988 | Wittrisch | 166/54.5 |
| 4,817,725 | | 4/1989 | Jenkins | 166/376 |
| 4,981,177 | | 1/1991 | Carmody et al. | 166/376 |
| 5,626,445 | * | 5/1997 | Nachbar et al. . | |
| 5,823,031 | * | 10/1998 | Campbell et al. . | |

FOREIGN PATENT DOCUMENTS

| | | |
|---|---|---|
| 0 511 735 A2 | 4/1992 | (EP) . |
| 2278135 A | 11/1994 | (GB) . |

* cited by examiner

*Primary Examiner*—Roger Schoeppel
(74) *Attorney, Agent, or Firm*—Finnegan, Henderson, Farabow, Garrett & Dunner, L.L.P.

(57) ABSTRACT

A pipe string in an oil well has a cable 2 slidingly attached along it. It may be necessary to break the pipe string. Apparatus is provided for controlling the position of a fracture in the cable, as it is desirable to break the cable at about the same point. The apparatus comprises a pocket 1 attached to the cable and having a passage through which the cable passes, and upper and lower nipples 5 and 6 attached to the cable in the pocket. The lower face 5' of the nipple 5 is skewed relative to the lower internal face 3' of the pocket and the facing faces (5", 6') of the two nipples are skewed relative to each other, so bending and kinking the cable when tension is applied. The cable therefore breaks at the bend or kink. The pipe string includes a plurality of such apparatuses located at spaced points along its length.

5 Claims, 2 Drawing Sheets

CONTROLLED BREAKING OF CABLES IN A WELL CASING

Figure 1C:
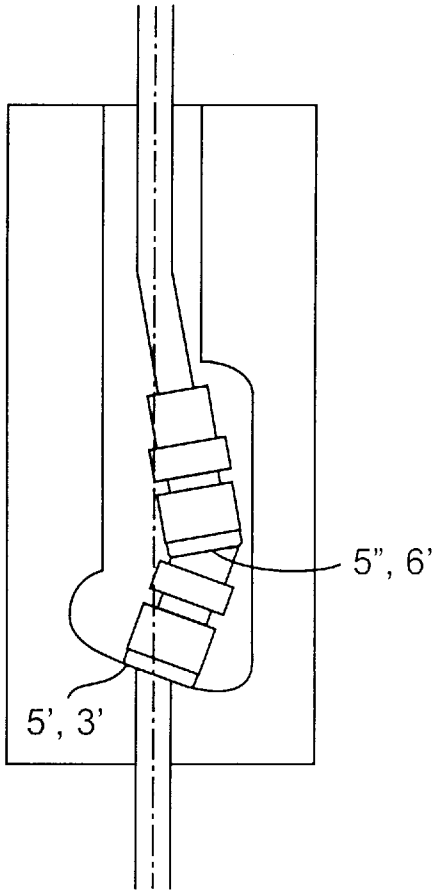

This application is a continuation of international application number PCT/NO00/00133, filed Apr. 18, 2000, and claims right to priority based on Norwegian Application No. 19991967, filed Apr. 26, 1999.

This invention relates to a method for generating counter forces in pipe couplings in order to position fractures on hydraulic and electrical cables which are slidingly attached along a production string.

For a variety of reasons, it is desirable to plan abandoning of oil and gas wells in advance, so that if this is deemed necessary, an abandoning operation will be conducted in a controlled manner and without causing any problems for the work involved in subsequent resumption of production.

Abandoning of the well is carried out by radially etching or machining off a section of the pipe wall in the production tubing down in the well; this releases the entire upper part of the production tubing, which can then be freely hoisted up to the drill floor.

Strings of production piping are normally joined together by pipe joints. Two pipe joints with threaded end pieces are screwed from each side into a corresponding threaded pipe coupling or collar, if the intention is to connect the pipe joints. When a well pipe string is established, the connection takes place on the drill floor before lowering. Well pipe strings can also be established by means of continuous coiled tubing.

A well normally has hydraulic and electrical control cables which are slidingly attached along the outside of the production tubing. When a well is abandoned today, the upper, released part of the production tubing is lifted up. The result of this is that, after the upper part of the production tubing has been lifted a short distance, the control cables will be broken off. The location of this break is not known in advance, and thus may occur at any point on the control cables, which are not cut in advance. If the break occurs high up in the well pipe string, these cables will gradually be released by sliding out through their points of attachment to the production tubing when it is raised, whereupon the cables will drop down and become tangled in the lower part of the borehole. This tangled mass of cables will impede access when production is subsequently resumed, since it has been found to be difficult to retrieve this mass of cables.

The object of the invention is to achieve the break of such cables, which are slidably attached along the production tubing, at a point below the location which is selected in advance as the point of break (abandonment).

Accordingly the invention provides, in a pipe string having a cable slidingly attached along it, apparatus for controlling the position of a fracture in the cable, characterised in that the apparatus comprises a pocket attached to the cable and having a passage through which the cable passes, and a nipple attached to the cable in the pocket, the lower face of the nipple being skewed relative to the lower internal face of the pocket. Preferably a second nipple is attached to the cable above the first nipple, the facing faces of the two nipples being skewed relative to each other.

The lower internal face of the pocket may be skewed and the lower face of the nipple level, or the lower internal face of the pocket may be level and the lower face of the nipple skewed.

The invention also provides a pipe string having a cable slidingly attached to it and including a plurality of such apparatuses located at spaced points along its length.

The present invention thus provides a method for generating counter forces in pipe couplings in order to position fractures on hydraulic and electrical cables which are slidingly attached along a production tubing in planned abandonment of an oil or gas well. The method for generating counter forces leading to positioned fracture of the cables is based on the use of a special pipe coupling, which replaces a standard pipe coupling in a production string, being installed at a point above the prospective point of abandonment which has been selected.

Through machined axial through-going holes in this special pipe coupling, each of the cables is led down into one of several longitudinal recessed pockets in the pipe coupling's outer side wall and then on down and out of the pipe coupling. It is also natural for the cables to be connected inside the recessed pocket. After installation, these pockets are covered by screwing on a protective cover on a level with the pipe coupling's other outer lateral surface.

Figure 1B:
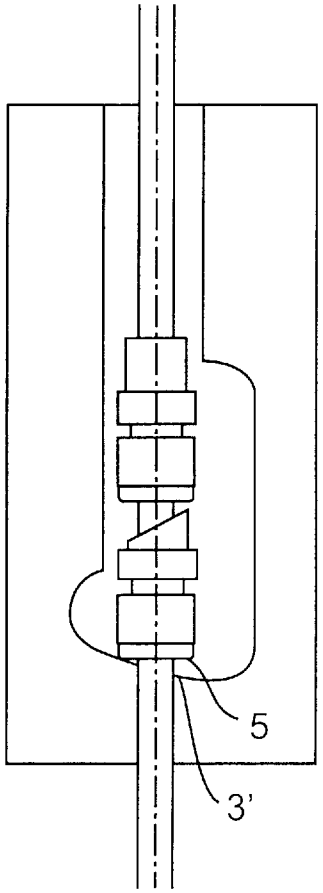
Figure 1A:
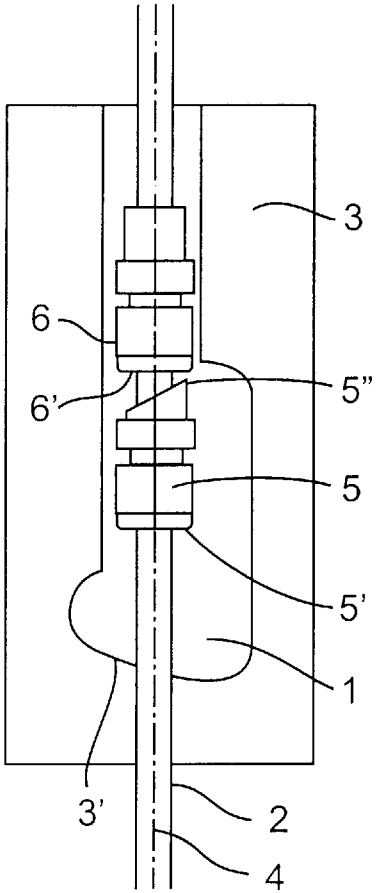
Figure 2B:
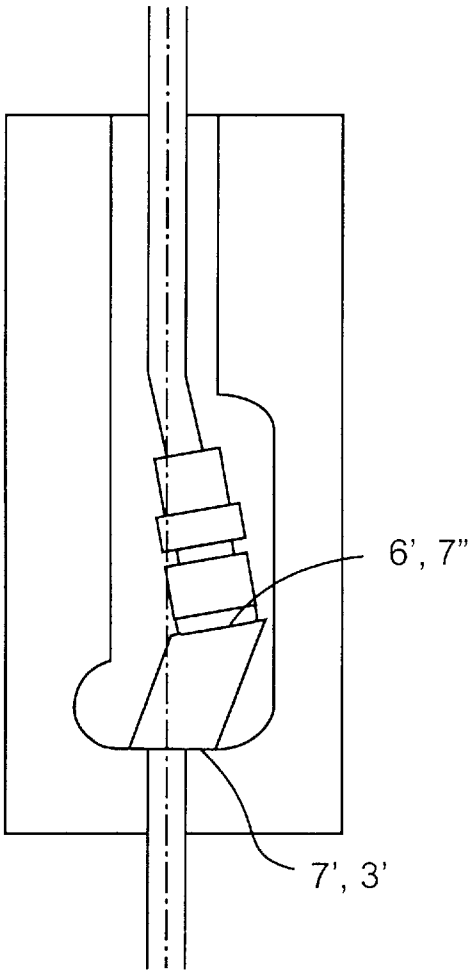
Figure 2A:
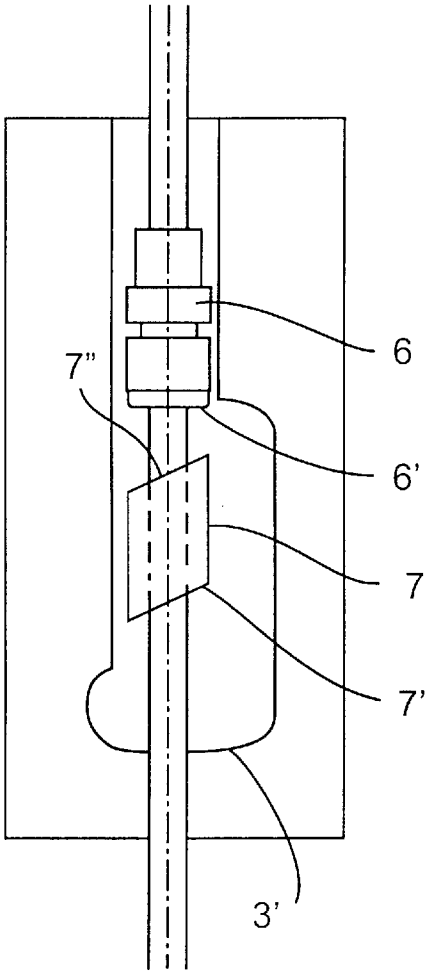

Apparatus embodying the invention will now be described, by way of example and with reference to the drawings, in which:

FIGS. 1A–1C show the first device in three successive stages of operation; and FIGS. 2A–2B show the second device in two successive stages of operation.

FIG. 1A shows a recessed pocket 1, which is formed in or attached to the pipe coupling wall 3, and includes a through-going hole 2. Hydraulic and electrical cables 4 pass axially through the hole 2 in the pipe coupling, and are permitted a certain amount of axial sliding movement when the production tubing is exposed to tension stresses during daily operation. Specially shaped nipples 5 and 6 are securely screwed to the part of cable 4 which extends through the pocket 1.

The lower face 3' of the pocket 1 is tilted at an angle of approximately 20° relative to the passage of the hole in the vertical direction. A sleeve-shaped lower nipple 5 is securely screwed to the cable 4 near, but not in contact with an upper nipple 6. The lower nipple's 5 lower face 5" extends perpendicularly to the cable 4, and consequently at an angle of approximately 20° to the pocket's lower wall 3', while the lower nipple's 5 upper face 5" is inclined at an angle of approximately 60° to the cable 4. The upper nipple's lower face 6' extends perpendicularly to the cable 4, and is consequently inclined at an angle of approximately 60° relative to the lower nipple's 5 upper face 5".

FIG. 1B shows a situation where abandoning of the well has been initiated. The upper part of the pipe string has been released from the lower part of the pipe string by radial etching or machining, and raising of the upper pipe string has started. At this stage the longitudinal cables which are slidingly attached to the pipe string will gradually be exposed to an increasing upwardly directed axial tension. The lower nipple's 5 lower face 5' will thereby be brought into contact with the pocket's 1 lower wall 3'.

FIG. 1C shows the situation when the tension load increases. The lower nipple's lower face 5' will first be forced to assume the same angle as the pocket's lower wall 3', with the result that the through-going cable 4 is also bent. With the tension load steadily increasing, the upper nipple's lower face 6' is then forced towards the lower nipple's upper and oppositely inclined face, thus causing the bending angle of the cable 4 to increase. The design of the pocket 1 permits the cable 4 with nipples 5 and 6 to bend in this fashion.

The two-phase bending of the cable 4 just described is what generates counter forces, which ensure that a cable fracture sustained during lifting can only occur on the part of the cable which is below the pipe coupling.

During daily operation, the cables 4 with attached nipples 5 and 6 are still capable of performing sliding axial movements through hole 2 and up and down in the pocket 1 in the pipe coupling when the production piping is exposed to a certain amount of axial tensile movement. Since the cables 4 slide through the attachment points along the production tubing's outer sides, the cables will not be broken off during daily operation if the production piping is exposed to a certain amount of axial tensile movement If, on the other hand, the cables 4 are exposed to upwardly directed prolonged tension, such as during abandonment of the well, the lower nipple 5 in the pocket 1, which is attached to the cables 4, will abut against the bottom surface 3 of the pocket 1 which is inclined at an angle of approximately 20°, with the result that transfer of the lifting force will force this nipple 5 to assume the same angle. Since nipple 5 is brought into securing co-operation with cable 4, cable 4 will also be forced to assume a similar angle. The upper nipple 6 attached to the cable 4 has an approximately 60° oppositely inclined lower face 6' relative to the cable, and when it is brought by means of lifting force towards the lower nipple's 5 upper face 5", it will be forced to assume a corresponding angle, also causing the cable 4 to assume a similar angle.

Thus an angled bend is produced on the cable secured in the nipples, thereby generating a counter force which is sufficiently strong to break off the cable as required below the pipe coupling.

FIG. 2A shows a simplified device for achieving bending of a cable with a securely screwed-on nipple 6 with perpendicular upper and lower faces. Between this nipple 6 and the pocket's lower wall 3', a sleeve 7 slidingly envelops the cable 4. The sleeve's lower face 7' is inclined at an angle of approximately 20° relative to the cable and is slightly smaller than the sleeve's upper face 7", which is inclined at an angle of approximately 45° relative to the cable 4.

FIG. 2B shows the situation when the tension load on the cable increases. The sleeve's lower face 7' first abuts against the bottom 3' of the pocket 1, forcing the cable to bend. The sleeve's upper face then abuts against the nipple's 6 lower face 6', forcing the cable 4 to bend even further.

In summary, the present invention provides a method for generating counter forces in pipe couplings for positioning fractures on hydraulic and electrical cables which are slidingly attached along a production piping.

One or more pockets 1 are recessed in a pipe coupling, integrated in a pipe string above a predetermined point of abandonment, before the pipe string is lowered in the well. Each of the pockets forms a part of a longitudinal hole 2 in the pipe coupling's outer side wall 3. The pocket's 1 lower wall 3' is inclined at an angle relative to the hole 2, which leads control cables 4 through a number of attachment points on the production tubing. A sleeve-shaped lower nipple 5 is secured to a cable 4 passing through the pocket 1, near to but not in contact with an upper nipple 6. The lower nipple's 5 face 5' extends perpendicularly to the cable 4 and at an angle to the pocket's 1 lower wall 3', and its upper face 5" is inclined at an angle of approximately 60° to the cable. The upper nipple's 6 lower face 6' extends perpendicularly to the cable 4 and is inclined at an angle relative to the lower nipple's 5 upper face 5".

During daily operation, the cables 4 are able to perform minor axial movements without being broken off. When the well is abandoned, lifting is initiated of the released upper part of the production string, comprising the pipe coupling with pockets 1. The lower nipple's 5 lower face 5' will then be forced to assume the same angle as the pocket's 1 lower wall 3', thereby bending the cable 4. As the tension increases, the upper nipple's 6 lower face 6' will be forced to assume the same angle as the lower nipple's 5 upper and oppositely inclined face 5", thus causing the cable's 4 bending angle to increase. The pocket's design causes the cable 4 with nipples 5 and 6 to be bent in this fashion.

What is claimed is:

1. In a pipe string having a cable (2) slidingly attached along it, apparatus for controlling the position of a fracture in the cable, characterised in that the apparatus comprises a pocket (1) attached to the cable and having a passage through which the cable passes, and a nipple (5) attached to the cable in the pocket, the lower face (5') of the nipple being skewed relative to the lower internal face (3') of the pocket.

2. Apparatus according to claim 1, characterised in that the lower internal face of the pocket is skewed and the lower face of the nipple is level.

3. Apparatus according to claim 1, characterized in that the lower internal face of the pocket is level and the lower face of the nipple is skewed.

4. Apparatus according to any previous claim, characterized by a second nipple (6) attached to the cable above the first nipple, the facing faces (5", 6') of the two nipples being skewed relative to each other.

5. A pipe string having a cable slidingly attached to it and including a plurality of apparatuses according to claim 1 located at spaced points along its length.

* * * * *